US009183769B2

(12) United States Patent
Newcomb

(10) Patent No.: US 9,183,769 B2
(45) Date of Patent: Nov. 10, 2015

(54) AUTOGRAPH BALL

(76) Inventor: Corky Faulks Newcomb, Mirror Lake, NH (US)

( * ) Notice: Subject to any disclaimer, the term of this patent is extended or adjusted under 35 U.S.C. 154(b) by 1661 days.

(21) Appl. No.: 11/566,445

(22) Filed: Dec. 4, 2006

(65) Prior Publication Data

US 2007/0124967 A1 Jun. 7, 2007

Related U.S. Application Data

(60) Provisional application No. 60/742,452, filed on Dec. 5, 2005.

(51) Int. Cl.
*G09F 23/00* (2006.01)
*G09F 27/00* (2006.01)

(52) U.S. Cl.
CPC ..... *G09F 27/00* (2013.01); *G09F 23/00* (2013.01); *G09F 23/0066* (2013.01)

(58) Field of Classification Search
CPC ... G09F 27/00; G09F 2027/002; G09F 23/00; G09F 23/0066; G09F 25/00
USPC ..... 446/397, 404, 491; 40/455, 446, 124.1, 40/124.3
See application file for complete search history.

(56) References Cited

U.S. PATENT DOCUMENTS 3,798,833 A 3/1974 Campbell
4,595,200 A 6/1986 Shishido
5,288,069 A 2/1994 Matsumoto
5,433,035 A 7/1995 Bauer
5,973,250 A * 10/1999 Zirille et al. ..... 84/600
6,082,774 A 7/2000 Schlauch
6,439,723 B1 * 8/2002 Tano ..... 353/15
6,464,602 B1 10/2002 Rottger
2006/0150460 A1 * 7/2006 Lowe et al. ..... 40/700
2006/0183576 A1 * 8/2006 Lindsey et al. ..... 473/570

FOREIGN PATENT DOCUMENTS

GB 2213069 A 9/1989

* cited by examiner

*Primary Examiner* — Jay Liddle
*Assistant Examiner* — Alex F. R. P. Rada, II
(74) *Attorney, Agent, or Firm* — Lyman Smith; Patent Service Associates

(57) ABSTRACT

The present invention adds a feature to the autograph ball in which the sports figure of interest adds a recorded message in addition to his or her autograph to the ball—for instance, personalizing the autograph ball; or simply recording a standard message such as "This is Ted Williams, the greatest hitter ever!" for posterity. In one embodiment, a ball shaped device is provided. The ball comprises an inner core that contains a recording means, a playback means, and advantageously, a switch that prevents erasure of the recorded message. The outer surface of the ball comprises a surface area suitable for placement of an autograph. With the ball of this invention, the sports fan is provided with not only the desired autograph, but also the recorded voice of the sports figure in question.

3 Claims, 4 Drawing Sheets

AUTOGRAPH BALL

CROSS-REFERENCE TO RELATED APPLICATION

This application claims priority under 35 U.S.C. 119(e) to commonly owned U.S. Provisional Patent Application Ser. No. 60/742,452, filed Dec. 5, 2005, the disclosure of which is hereby incorporated herein by reference.

FIELD OF THE INVENTION

Autograph balls, for example baseballs, softballs, footballs, basketballs, soccer balls, dodge balls, golf balls, tennis balls, and the like, have traditionally had the shape and appearance of a conventional playing device of the particular sport. Other non-ball sports objects, such as hockey pucks, hockey sticks, baseball bats, helmets, and the like, which while not balls, are often used as autograph objects, and thus these are also specifically included herein within the definition of "autograph balls" or simply "ball."

The ball owner either purchases the ball with the desired autograph already in place, e.g., as sports memorabilia, or the ball owner is lucky enough to have the desired autograph placed directly on the ball by the sports figure of interest. Owning an autographed ball, particularly of a famous player, is often seen as one of life's great achievements. The present invention adds another dimension to the traditional autograph ball—the recorded voice of the sports figure in question.

BACKGROUND OF THE INVENTION

Sports balls with recorded playback messages are known. See for example U.S. Pat. Nos. 3,798,833; 4,595,200; 5,288,069; 5,433,035; 6,082,774; 6,464,602 and 6,736,429, the disclosures of which are hereby incorporated herein by reference. See also, GB Patent Publication Nos. 2213069 and 2277037. These prior art balls are all designed with a specific purpose, none of which is related to sports memorabilia. It is believed that the present invention, which provides a sports fan with a sports ball device that is capable of (1) providing a suitable surface for an autograph; and (2) provides means to record and playback a recorded message from a desired sports figure or legendary player; is entitled to patent protection.

SUMMARY OF THE INVENTION

As set forth above, owning a sports autograph on a sport ball is only an aspect of the sports memorabilia craze. The present invention adds a feature to the autograph ball in which the sports figure of interest adds a recorded message in addition to his or her autograph to the ball—for instance, personalizing the autograph ball; or simply recording a standard message such as "This is Ted Williams, the greatest hitter ever!" for posterity. With the autograph ball of this invention, the sports fan is provided with not only the desired autograph, but also the recorded voice of the sports figure in question.

Accordingly, in one embodiment of the present invention, a sports memorabilia device is provided, having an inner core and an outer surface. The inner core contains a voice recording means, an externally accessible microphone operationally connected to the recording means, a playback means, an externally accessible speaker operationally connected to the playback means, and an electrical power supply operationally connected to the recording means and the playback means. The outer surface has a surface area suitable for placement of an autograph, and one or more switches operationally connected to the recording means and the playback means. The outer surface can be made from any suitable material (e.g., plastic, leather, cloth, and the like) that will accept an autograph. In another embodiment of the present invention, a ball is provided having the above-described inner core and outer surface.

The inner core needs only to support the recording means and the playback means, each of which is preferably based upon standard miniaturized chips and electronic circuitry. The externally accessible microphone and speaker are both required elements of the invention. Playback can be accomplished through either a single speaker, or via multiple speakers. Preferably, the recording means is activated by a record switch, and the playback means is activated by a play switch. Advantageously, the sports memorabilia device or ball further comprises a kill switch that prevents erasure of a message recorded by the recording means. This switch can be disabled if the ball owner wishes to record another message over a previously recorded message.

Preferably, the electrical power supply of the sports memorabilia device or ball comprises a battery compartment suitable for housing at least one battery, such as an AA 1.5 V battery, a lithium cell, a silver oxide cell, or a mercury cell. The outer surface of the sports memorabilia device or ball may further comprise a removable cover over the battery compartment.

Another preferred feature of the sports memorabilia device or ball of the present invention is a photo slot where a sports fan can put his favorite player's photograph. In these embodiments, the outer surface of the sports memorabilia device or ball further comprises a clear window with a slot at one edge of the window suitable for inserting and displaying a photograph. This way one has three memorabilia options in one device; (1) the player's autograph, (2) the player's photograph; and (3) the player's recorded voice. The sports fan can have a photograph of himself standing next to his favorite player (e.g., at Spring training) and that will prove to future generations of his family that he really did meet Ted Williams, get his autograph, and had him record is voice inside the baseball. Of course, since Mr. Williams is no longer with us, the sports fan may have to settle for another sports legend.

In accordance with another aspect of the present invention, the sports memorabilia device can have the shape of a baseball, softball, football, basketball, soccer ball, golf ball, tennis ball, hockey puck, hockey stick, baseball bat, helmet, and the like. "Non-ball" shaped sports objects, such as hockey pucks, hockey sticks, baseball bats, helmets, and the like, are included herein, as these too can be modified to include the necessary recording means, playback means, and advantageously, a switch that prevents erasure of the recorded message. In accordance with another aspect of the present invention, the ball can have the shape of a baseball, softball, football, basketball, soccer ball, golf ball, tennis ball, or other sports ball. The sports memorabilia device or ball can have either a traditional size (e.g., for baseballs and the like), a miniature size (e.g., for basketballs and the like) or an enlarged size (e.g., for golf balls and the like), so that a suitable autograph surface is provided.

Another embodiment of the present invention is a method for making sports memorabilia comprising the steps of:

a) providing a sports memorabilia device comprising an inner core and an outer surface, wherein the inner core comprises a voice recording means, an externally accessible microphone operationally connected to the recording means, a playback means, an externally accessible speaker operationally connected to the playback means, and an electrical power supply operationally connected to the recording means and the playback means; and wherein the outer surface comprises a surface area suitable for placement of an autograph, and one or more switches operationally connected to the recording means and the playback means;

b) activating the recording means using a record switch; and c) recording a voice message from a sports figure.

Preferably, the method for making sports memorabilia further comprises the step of placing an autograph of the sports figure on the outer surface. Preferably, the method for making sports memorabilia further comprises the step of using a kill switch to prevent erasure of the recorded message. Preferably, the method for making sports memorabilia further comprises the step of activating the playback means using a play switch to play the recorded voice message. Optionally, the method for making sports memorabilia further comprises the steps of:

reactivating the recording means using the record switch, and recording another voice message from a sports figure.

In another embodiment, step a) of the method for making sports memorabilia further includes a clear window on the outer surface with a slot at one edge of the window suitable for inserting and displaying a photograph. The method for making sports memorabilia can then further comprise the steps of:

obtaining a photograph of the sports figure; and inserting the photograph into the slot so that the photograph is displayed through the clear window.

Optionally, a number of accessible recording stations can be located within the ball, so that if adequate stations were available, an entire team could record messages in the ball. Optionally, the ball may be sold with a pre-recorded message. Such items would be useful as promotional items, for teams, for businesses, for charitable organizations, and the like.

The voice recording portion of this invention is a critical aspect—since one of the problems in the sports memorabilia field is the fact that hand signed autographs can be faked, but voices are very hard, if not impossible, to accurately and completely duplicate. Likewise, hand signed autographs may tend to fade over time, but the recorded voice should remain clear forever.

DETAILED DESCRIPTION OF THE INVENTION

The ball of the present invention must have an outer surface suitable for an autograph. Preferably, such a surface is relatively smooth, but golf balls, footballs and basketballs typically have a rough surface, and autographs are regularly placed thereon—so these types of surfaces are clearly part of the present invention.

The inside of the ball must have a recording means and a playback means. These are the essential items for this aspect of the invention. Both are powered by electricity, either from a battery (replaceable or rechargeable), or by solar power.

Small batteries are well known. For example, the device can be powered by a number of AA 1.5 V batteries, connected in series to provide the necessary power supply. Other suitable battery types are the well-known small batteries known as lithium cells, silver oxide cells, mercury cells, and the like. These batteries are suitable for the present invention due to their light weight and large capacity. The battery compartment is advantageously provided with a removable cover so that the batteries, when exhausted, may be replaced.

Miniature loudspeakers are also well known. The speaker must be located against the outer wall of the ball, so that when the play button is pressed, the recorded voice and message will be heard by the user. The speaker may be a piezoelectric speaker, or a similar miniature device.

Miniature sound recording devices, particularly microelectronic integrated circuit chips, such as those that include a solid-state data memory, preferably in the form of a ROM (Read-Only-Memory), are also well known. A ROM is a solid-state, non-volatile memory which, once digital data is loaded into is discrete storage sites, then stays therein even if the power is shut off. Thus, the recorded message is retained by the ball.

As described above, the necessary record and play switches, as well as the optional kill switch, each need to be activated from the outside of the ball. Suitable electronic circuitry will connect each switch to the remainder of the device; e.g., the record switch will be connected to the integrated circuit for recording speech; the play switch is connected to the recorded memory and to a suitable integrated circuit for an audio playback, preferably with an amplifier. An integrated circuit for the audio amplifier will preferably amplify both the speech processor and a controller, and the speech recorder. The audio amplifier will be connected to a speaker. The entire electronic circuitry system will be powered by batteries. The recording microphone will be connected to the speech recorder.

Example

One embodiment of the invention is illustrated in FIGS. 1-5. The ball (100) has a shape and appearance of a traditional baseball, but the outer surface (110) includes a smooth plastic surface suitable for one or more autographs.

Figure 1:
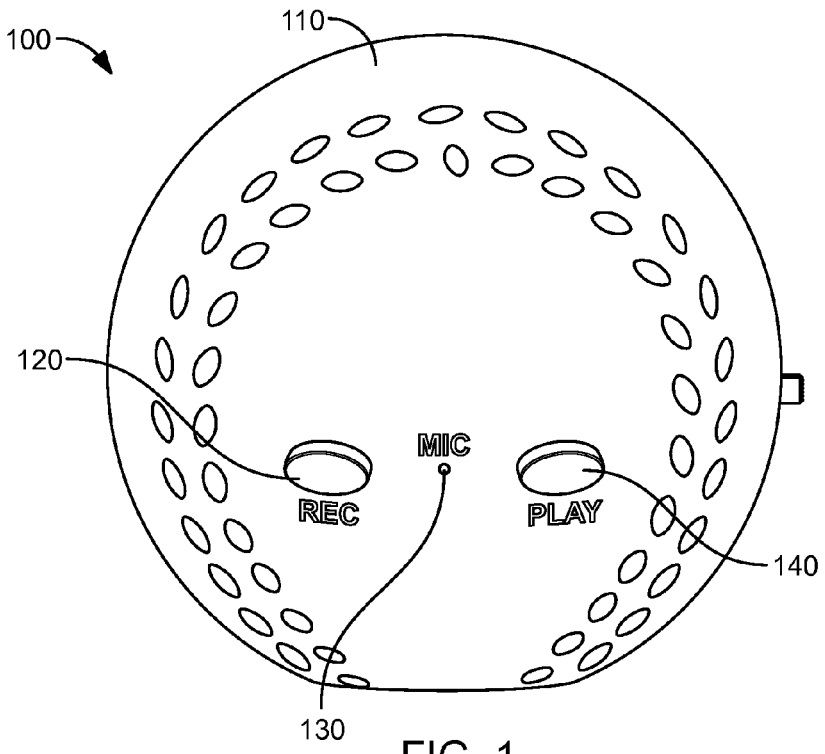
FIGS. 1-7 show one embodiment of the present invention, a baseball suitable for autographs, from various angles, showing locations of the parts described herein.

FIG. 1 best illustrates the working parts of the ball on the outer surface; namely the record (rec) switch (120) and the microphone hole (130) as well as the play switch (140).

Figure 2:
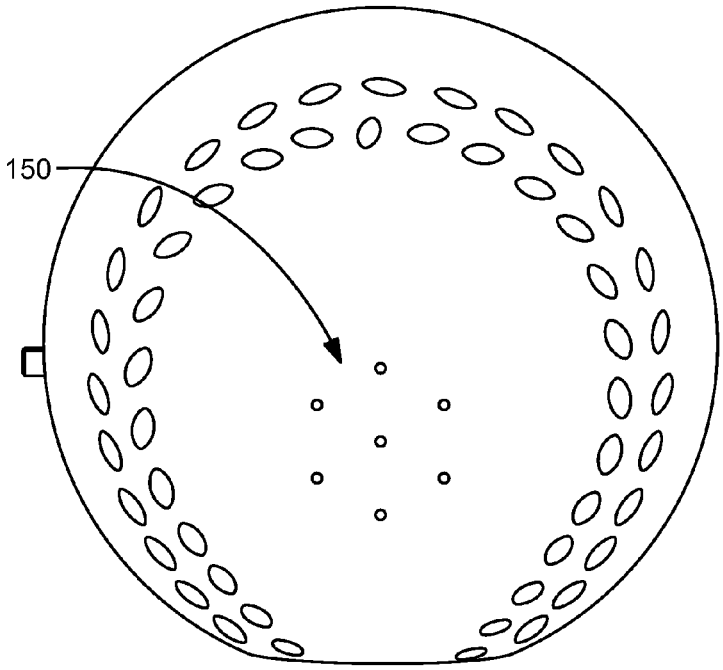

FIG. 2 best illustrates the external speaker section (150) through the outer surface of the ball as small holes in the surface material. Other variations can be made, depending upon the nature of the material on the outside of the ball.

Figure 3:
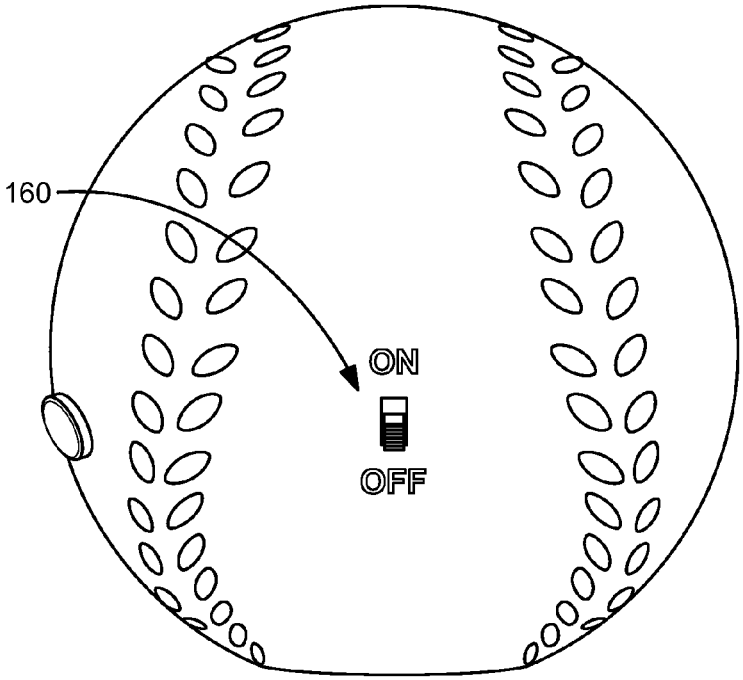

FIG. 3 best illustrates the optional on/off or "kill" switch (160) which is used to prevent accidental erasure of a previously recorded message in the ball. Of course, when a new message is desired, this switch is set to the "on" position which activates the record button and allows a new message to be recorded.

Figure 4:
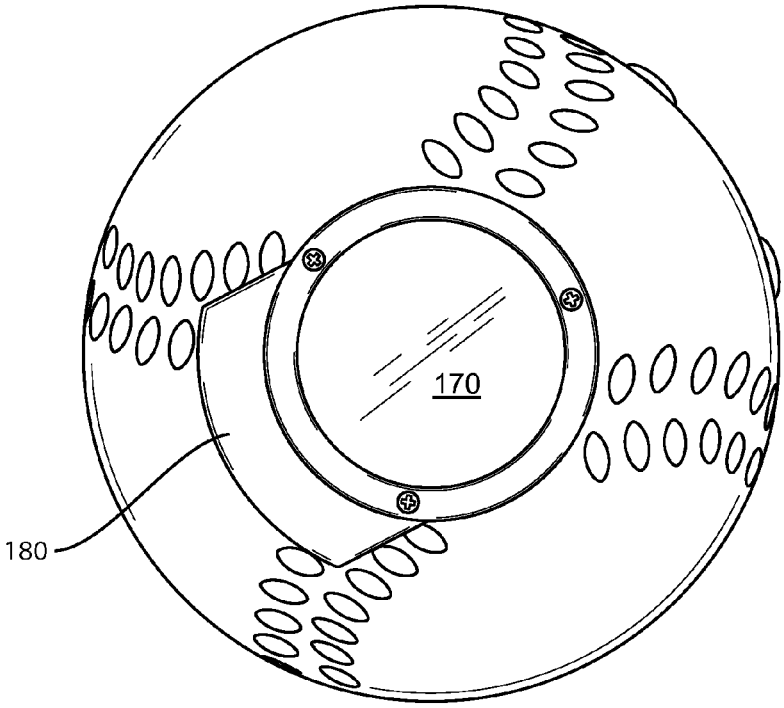

FIG. 4 best illustrates the bottom of the ball, which shows the battery compartment (170). A second cover over the battery compartment is further provided with a clear window (180) and this portion of the ball serves as a photograph holder (photo not shown).

Figure 5:
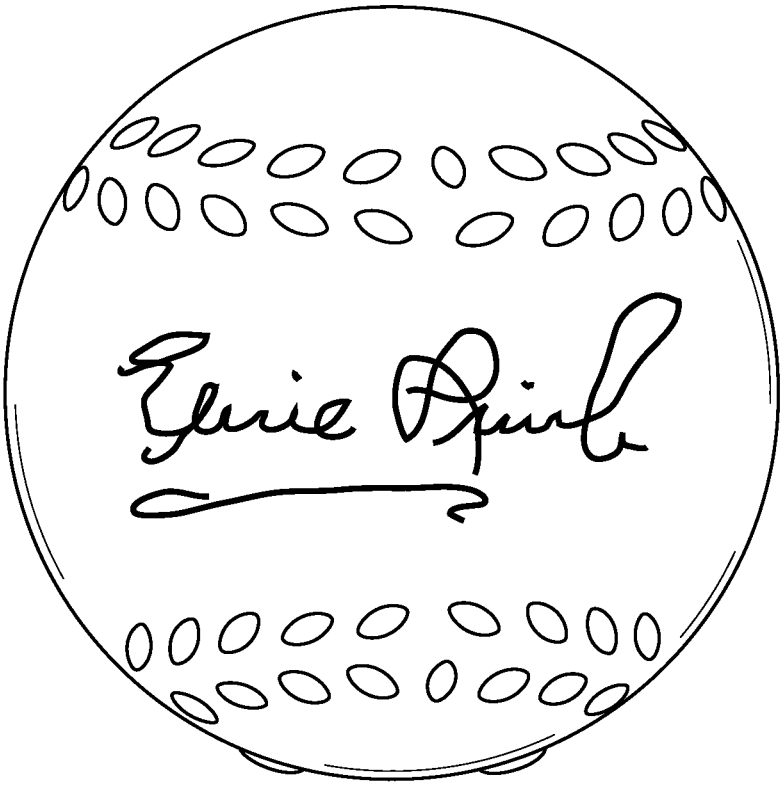

FIG. 5 best illustrates the overall shape and appearance of the ball.

Figure 6:
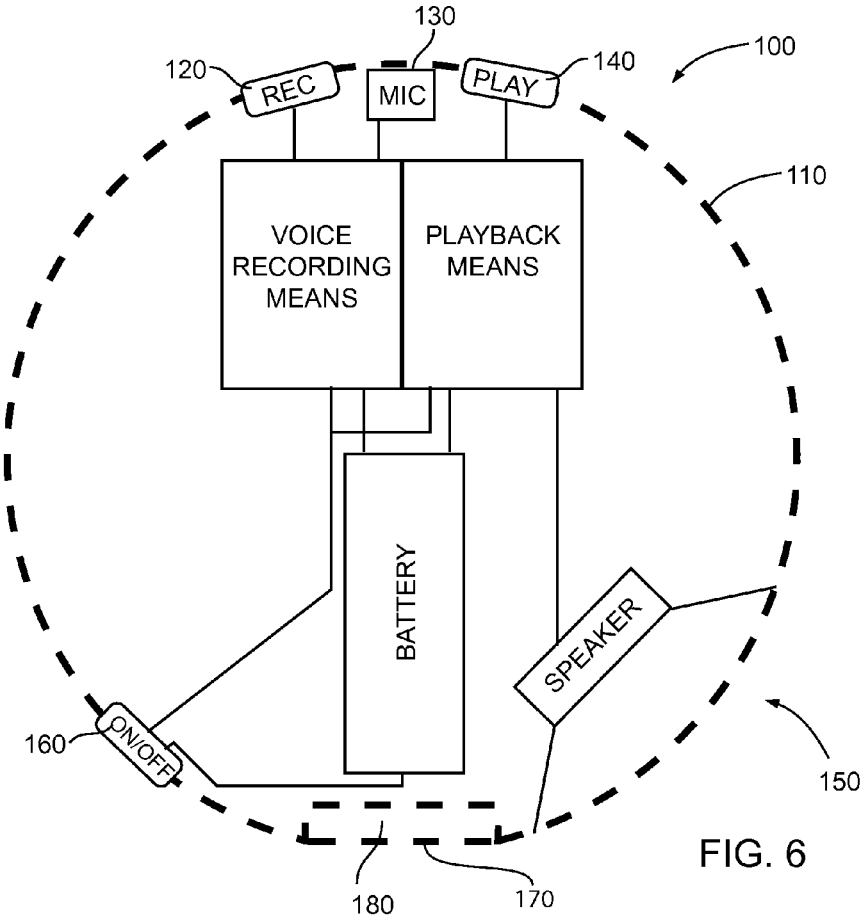

FIG. 6 is a diagram of the ball components.

Figure 7:
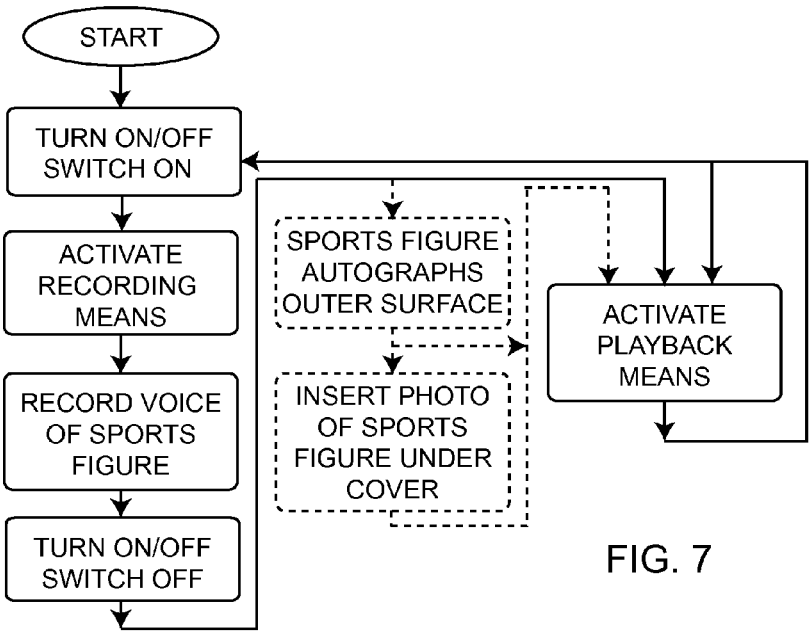

FIG. 7 is a flow diagram of one method of using.

Another embodiment of the present invention changes the shape of the device to that associated with another sport, for instance NASCAR. In this embodiment, the device would be in the shape of TALKING TIRES—and these would be used for recording the voices of NASCAR drivers. There are 75 million NASCAR fans in this country, and they spend over $2 BILLION on licensed merchandise every year.

In another embodiment of the invention, these talking balls can have pre-recorded messages, for example, by famous players making a public service announcement—such as; "HEY KIDS, THIS IS DAVID ORTIZ OF THE BOSTON RED SOX. I AM HERE TO TELL YOU DON'T DRINK, DON'T SMOKE, DON'T TAKE DRUGS OR STEROIDS AND DON'T DRIVE YOUR CAR FAST!"

In another aspect of the invention; the simple act of speaking into the device can be an attractive aspect of securing the desired sports figure's attention. This is because speaking into the device can be much faster than writing and autograph. This is especially true when multiple copies of the same message are being created (e.g., for a public service recording, or a give-away promotion at a sporting event—a single master recording could be made—and that one used for any number of devices.

Player's may prefer to give a voice autograph instead of a written autograph because it saves time. It can be more personal because DAVID O. is saying, "HAPPY BIRTHDAY, ERNIE!" Also many players do not have clear writing and you cannot tell who signed the ball a month or year after you get the autograph. What is the value in that? Most everyone speaks clearly. When the present inventor got former Red Sox ace pitcher Louie Tiant to record his secrets of pitching in August 2006 at Fenway Park using the present invention, everyone can understand what he said about "The keeeey to pitching goooooooooood is the reeeeleeeeease point."

What is claimed is:

1. A sports memorabilia device comprising an object of play of a preferred sport having an inner core and an outer surface, wherein the inner core comprises a voice recording means, a kill switch that prevents erasure of a message recorded by the recording means, an externally accessible microphone operationally connected to the recording means, a playback means, an externally accessible speaker operationally connected to the playback means, and an electrical power supply operationally connected to the recording means and the playback means; and wherein the outer surface comprises a surface area suitable for placement of an autograph, and one or more switches operationally connected to the recording means and the playback means.

2. A sports ball comprising an inner core and an outer surface, wherein the inner core comprises a voice recording means, a kill switch that prevents erasure of a message recorded by the recording means, an externally accessible microphone operationally connected to the recording means, a playback means, an externally accessible speaker operationally connected to the playback means, and an electrical power supply operationally connected to the recording means and the playback means; and wherein the outer surface comprises a surface area suitable for placement of an autograph, and one or more switches operationally connected to the recording means and the playback means.

3. A method for making sports memorabilia comprising the steps of:

a) providing a sports memorabilia device comprising an object of play of a preferred sport having an inner core and an outer surface, wherein the inner core comprises a voice recording means, a kill switch to prevent erasure of a message recorded by the recording means, an externally accessible microphone operationally connected to the recording means, a playback means, an externally accessible speaker operationally connected to the playback means, and an electrical power supply operationally connected to the recording means and the playback means; and wherein the outer surface comprises a surface area suitable for placement of an autograph, and one or more switches operationally connected to the recording means and the playback means;

b) activating the recording means using a record switch; and c) recording a voice message from a sports figure; and d) activating the kill switch to prevent erasure of the message.

* * * * *